US010219622B1

(12) United States Patent
Garner

(10) Patent No.: US 10,219,622 B1
(45) Date of Patent: Mar. 5, 2019

(54) COMPACT DESK AND CHAIR ENSEMBLE

(71) Applicant: Denise Garner, Red Lion, PA (US)

(72) Inventor: Denise Garner, Red Lion, PA (US)

( * ) Notice: Subject to any disclaimer, the term of this patent is extended or adjusted under 35 U.S.C. 154(b) by 0 days.

(21) Appl. No.: 15/829,324

(22) Filed: Dec. 1, 2017

(51) Int. Cl.

| | |
|---|---|
| ***A47B 83/00*** | (2006.01) |
| ***A47B 83/02*** | (2006.01) |
| ***A47C 7/00*** | (2006.01) |
| ***A47B 83/04*** | (2006.01) |
| ***A47C 5/04*** | (2006.01) |
| ***A47B 13/06*** | (2006.01) |
| ***A47C 7/40*** | (2006.01) |

(52) U.S. Cl.
CPC ..... *A47B 83/021* (2017.08); *A47B 13/06* (2013.01); *A47B 83/001* (2013.01); *A47B 83/045* (2013.01); *A47C 5/04* (2013.01); *A47C 7/006* (2013.01); *A47C 7/407* (2013.01)

(58) Field of Classification Search
CPC ..... A47B 83/02; A47B 83/045
USPC ..... 312/235.3; 297/140
See application file for complete search history.

(56) References Cited

U.S. PATENT DOCUMENTS

| | | | | | |
|---|---|---|---|---|---|
| 1,838,558 | A * | 12/1931 | Kolodny | A47B 13/16 | 108/26 |
| 4,026,616 | A * | 5/1977 | Kuehl | A47B 77/02 | 312/201 |
| 4,337,988 | A * | 7/1982 | Schenck | A47B 83/045 | 16/35 R |
| 5,547,270 | A * | 8/1996 | Dang | A47B 39/00 | 297/140 |
| 7,469,849 | B1 * | 12/2008 | Lo | B02C 18/0007 | 241/100 |
| 2011/0210593 | A1 * | 9/2011 | Klaasen | A47C 7/407 | 297/378.12 |

* cited by examiner

*Primary Examiner* — Matthew W Ing
(74) *Attorney, Agent, or Firm* — Richard K Thomson

(57) ABSTRACT

A desk is composed of a metal frame defining a plurality of compartments and floor-engaging boxes, while supporting a desk top and a plurality of sliding drawers. A plurality of storage cabinets can be rolled into and out of one of the plurality of compartments by rolling each of them on their casters and lifting those casters out of its respective floor-engaging box. Similarly, the chair has a back that folds down permitting it to be stored in one of the compartments entirely beneath the desk top.

2 Claims, 1 Drawing Sheet

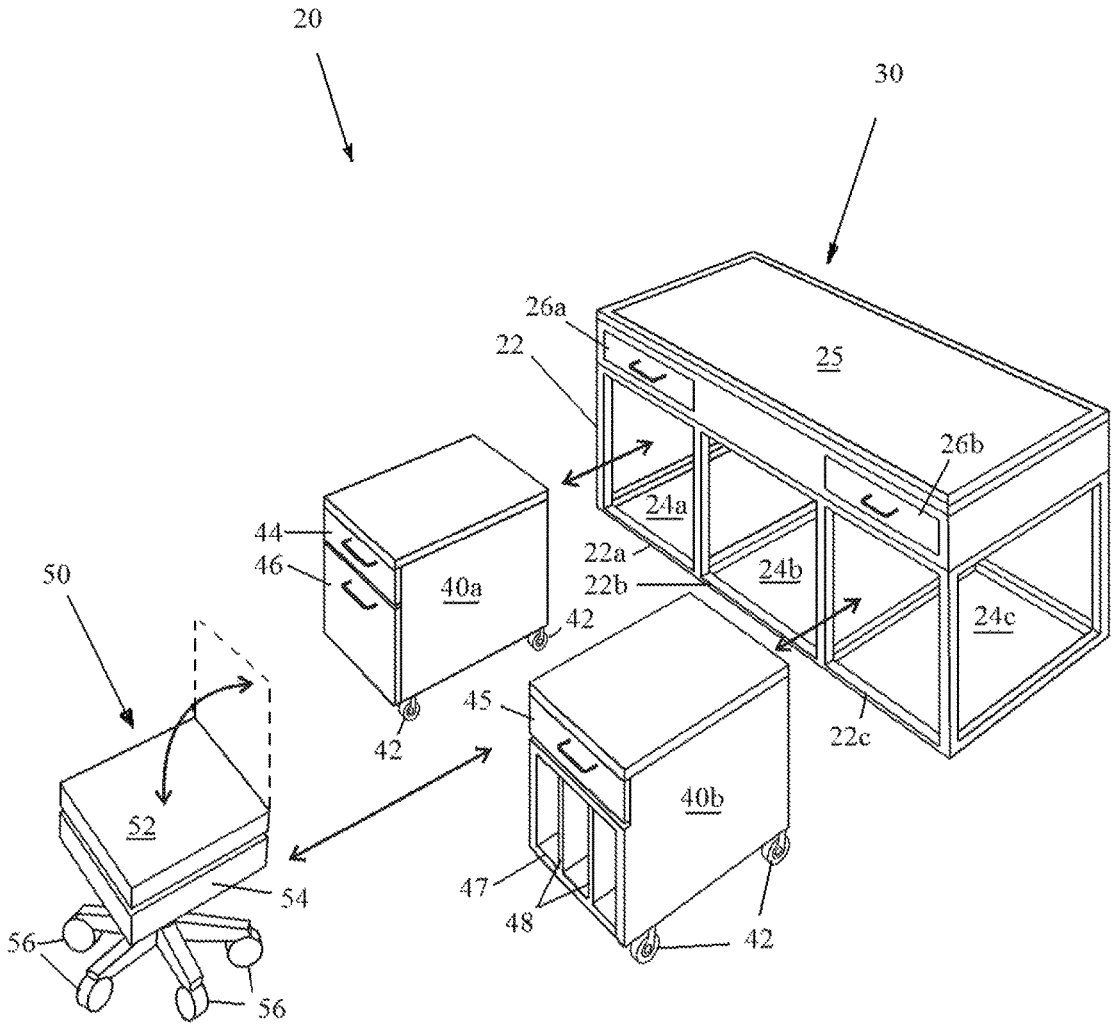
20
30
26a
22
25
26b
24a
22a
22b
24b
24c
22c
44
46
40a
42
42
50
45
40b
52
54
47
48
42
56
56

COMPACT DESK AND CHAIR ENSEMBLE

BACKGROUND AND SUMMARY OF THE INVENTION

The present invention is directed to the field of furniture. More particularly, the present invention is directed to a compact desk and chair ensemble.

Conventional office furniture including desks with storage cabinets, shelves, etc., along with office chairs, tend to be bulky taking up too much room to be accommodated in a dorm room or average apartment. It is among the objects of the present invention to provide a suitable compact desk and chair ensemble that can more readily be received in a compact space while providing versatile and adequate storage space.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which FIG. 1 is a front perspective view of a first embodiment of the compact desk and chair ensemble of the present invention.

DETAILED DESCRIPTION OF THE PREFERRED EMBODIMENT(S)

A first embodiment of the compact desk and chair ensemble of the present invention is depicted in FIG. 1 generally at 20. Ensemble 20 is made up of desk 30 and collapsible chair 50. Desk 30 is comprised of a steel (or aluminum) frame 22 that defines 3 compartments 24*a*, 24*b*, 24*c*, a desk top 25 extending over two drawers 26*a*, 26*b* and two storage cabinets 40*a* and 40*b*. Storage cabinets 40*a* and 40*b* are each provided with four casters 42 to permit them to be inserted into and removed from compartments 24*a* and 24*c*, respectively, although the positions of the cabinets 40*a* and 40*b* can be swapped, if desired. Storage cabinet 40*a* is provided with an upper drawer 44 and a lower drawer 46, the lower drawer 46 being a filing cabinet style drawer to accommodate a plurality of hanging files, or the like. Storage cabinet 40*b* has an upper drawer 45 and an open-faced shelf 47 with a plurality of vertical dividers 48 to accommodate text books, reference books, and the like. The steel frame 22 has two floor-engaging boxes 22*a*, 22*c* which form enclosures that restrict casters 42 from rolling retaining storage cabinets 40*a* and 40*b* within compartments 24*a*, 24*c* until they are intentionally removed therefrom to facilitate access thereto.

Collapsible chair 50 has a back 52 that folds down onto seat 54 permitting chair to be slid into compartment 24*b* by rolling it on its casters 56 and retained therein by floor-engaging box 22*b*. Back 52 may be made with multiple-position adjustment capability, if desired.

The compact desk 30 and chair 50 ensemble 20 of the present invention is elegant in its simplicity, being easy and inexpensive to manufacture, providing a compact unit that supplies all the functionality needed in a compact space.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A compact desk and chair ensemble comprising:

a) a metallic frame supporting a desk top and a plurality of sliding drawers, said metallic frame defining a plurality of compartments and floor-engaging boxes wherein each of said boxes sits directly upon the floor and forms an enclosure which extends through 360° and is opened on the bottom exposing the floor beneath;

b) a first storage cabinet provided with casters allowing it to be inserted into and removed from one of said compartments, the enclosure of a corresponding floor-engaging box surrounding said casters assuring said first storage cabinet being retained in said one of said compartments;

c) a second storage cabinet provided with casters allowing it to be inserted into and removed from one other of said compartments, the enclosure of a corresponding floor-engaging box enclosing said second storage cabinet surrounding said casters assuring said second storage cabinet being retained in said one other of said compartments;

d) a chair having casters permitting said chair to be rolled into one of said plurality of compartments for storage.

2. The ensemble of claim 1 wherein a back of said chair collapses upon a seat of said chair enabling said chair to fit entirely under said desk top.

* * * * *